US009486058B1

(12) United States Patent
Moreau et al.

(10) Patent No.: US 9,486,058 B1
(45) Date of Patent: Nov. 8, 2016

(54) TOOL VEST

(71) Applicant: Ty-Flot, Inc., Manchester, NH (US)

(72) Inventors: Darrell A. Moreau, Derry, NH (US); Andre W. Moreau, Bedford, NH (US)

(73) Assignee: Ty-Flot, Inc., Manchester, NH (US)

( * ) Notice: Subject to any disclaimer, the term of this patent is extended or adjusted under 35 U.S.C. 154(b) by 0 days.

(21) Appl. No.: 14/727,217

(22) Filed: Jun. 1, 2015

(51) Int. Cl.
*A45F 5/02* (2006.01)
*A45F 3/00* (2006.01)
*A41D 1/04* (2006.01)

(52) U.S. Cl.
CPC . *A45F 3/00* (2013.01); *A41D 1/04* (2013.01); *A45F 5/02* (2013.01); *A45F 2003/003* (2013.01); *Y10T 24/1382* (2015.01)

(58) Field of Classification Search
CPC ..... A45F 5/02; A45F 5/021; Y10T 24/1382; A41D 13/0012
USPC ..... 224/675, 904, 674, 578, 627, 645; 24/3.7
See application file for complete search history.

(56) References Cited

U.S. PATENT DOCUMENTS 5,259,093 A 11/1993 D'Annunzio
5,724,707 A 3/1998 Kirk et al.
6,892,395 B2 * 5/2005 Schweer ..... A41D 13/0007 182/3
7,080,430 B2 7/2006 Wemmer
7,200,871 B1 4/2007 Carlson
7,240,404 B2 7/2007 Flossner
7,389,899 B2 * 6/2008 Johnson ..... A45F 5/02 224/675
7,690,542 B1 * 4/2010 Silvera ..... A45C 11/00 224/237
7,694,862 B2 * 4/2010 Bergeron ..... A45F 5/02 224/665
7,780,048 B2 * 8/2010 Howell ..... A41D 13/0012 224/196
8,453,899 B1 * 6/2013 Calkin ..... A45F 5/02 224/675
8,505,114 B1 * 8/2013 Earley ..... A45F 5/004 2/101
8,523,029 B2 9/2013 Rogers et al.
8,572,762 B2 * 11/2013 Herbener ..... F41H 1/02 2/2.5
8,595,862 B2 * 12/2013 Storms, Jr. ..... A41D 13/05 2/102
8,608,041 B1 * 12/2013 Adkisson ..... A45F 5/00 2/102
9,144,255 B1 * 9/2015 Perciballi ..... A41D 27/00
9,144,294 B2 * 9/2015 Gregory ..... A41D 13/0012
9,173,436 B2 * 11/2015 Crye ..... A41D 13/0007
9,295,319 B1 * 3/2016 Hilliard ..... F42B 39/02
2004/0099705 A1 * 5/2004 Skupin ..... B25H 3/00 224/674
2007/0023470 A1 * 2/2007 Roberts ..... A45F 3/04 224/644
2012/0168472 A1 * 7/2012 Mathews ..... A45F 3/14 224/162
2014/0151424 A1 * 6/2014 Hexels ..... A45F 3/06 224/637
2015/0334140 A1 * 11/2015 Singh ..... G06F 3/00 709/204
2016/0040958 A1 * 2/2016 Alcantra ..... A45F 5/02 224/182

FOREIGN PATENT DOCUMENTS

CA 2553112 A1 7/2006

OTHER PUBLICATIONS

TLC Southern, LTD., Technicians Vest CK 415007, available at http://t1c-direct.co.uk/Products/CK415007.html (admitted prior art).

* cited by examiner

*Primary Examiner* — Justin Larson
(74) *Attorney, Agent, or Firm* — Mesmer & Deleault, PLLC

(57) ABSTRACT

A wearable upper-body garment has a plurality of first webbings secured to the garment front panel in a substantially parallel relation, each of the plurality of first webbings defining at least one passageway between the webbing and the front panel with the passageways extending perpendicular to the webbing. The first webbings extend upwardly and outwardly from a sternal region on the front panel that divides the garment front panel into a right half and a left half.

8 Claims, 10 Drawing Sheets

TOOL VEST

BACKGROUND OF THE INVENTION

1. Field of the Invention

The present invention relates generally to wearable tool holders. More particularly, the present invention relates to a tool vest.

2. Description of the Prior Art

Workers engaged in industrial plant maintenance, construction work, and the like use a variety of hand tools to perform tasks. The work commonly takes place at various heights above the ground and at times is positioned over machinery or other workers. Accordingly, working at height provides many reasons to avoid dropping tools. For instance, a dropped tool wastes time and energy of the worker who must climb down from an elevated location to retrieve the dropped tool before work can continue. Oftentimes, the dropped tool will land in a place out of the user's sight. A search undertaken to locate the tool, even if brief, further wastes valuable work time and interrupts the work flow.

Another more serious concern with dropped hand tools (i.e. hammers, screw drivers, pliers, ratchets, levels, flashlights, tape measures, etc.) is the risk of damage to equipment and death or injury to workers below the drop. Plant equipment can be damaged due to the impact of the falling tool on the machinery or parts. A tool dropped into cooling systems, liquid storage tanks, and other systems may require shutting down machinery or entire operations until the dropped tool can be retrieved.

Even though workers who use hand tools try diligently to maintain a secure grip on the tool, conditions are practically certain to arise in which tools will be dropped. To address tools dropped during use, tool lanyards and tethers have been used to secure the tool to a harness or structure.

U.S. Pat. No. 4,728,123 (1988, Kassal et al.) discloses a releasable strap system. The releasable strap system includes the combination of a hand strap and a device strap. The hand strap is removably connectable around the wrist of a hand and between two of the five fingers of the hand, leaving the hand free for normal use. The hand strap includes two portions, a straight wrist portion and a curved looped portion. The curved loop portion has two ends connected to the straight wrist portion at separated intervals. The straight wrist portion is wrapped around the wrist of the user, threaded through a ring, tightened, and then folded back and locked in position. The device strap is removably connected to the hand strap for supporting an item not held in the user's hand and for quick release from the hand strap.

U.S. Pat. No. 5,130,899 (1992, Larkin et al.) discloses a tool restraint apparatus. The tool restraint includes an elongate elastomeric tether line with respective first and second flexible straps mounted to each end. The first web strap is arranged for selective securement about a user's wrist and includes a first and second end that includes first and second hook-and-loop fastener patches that permit securement of the hook-and-loop fastener patches together. The second web strap is similarly constructed like the first web strap.

Tool drops also occur due to a tool being knocked loose from the worker's tool belt or pocket while climbing or moving about a structure. Workers also use tool pouches designed for certain types of tools, where the tool pouch is removably attached to a tool belt using straps that snap or hook together. Similarly, a tool pouch may be accidentally knocked loose from a tool belt and allowed to fall to the ground.

Carpenter's belts and pockets on vests or pants have been useful for storing tools between uses. Although useful, carpenter's belts and tool pouches sometimes are not configured to securely hold the tool needed for a given job. In such a situation, the worker may need to reconfigure tool pouches on the tool belt, which involves removing some tool pouches and replacing the removed pouches with different tool pouches. Nonetheless, a tool belt has limited space to hold tools and tool pouches.

To address the need to modify one's clothing and equipment for the job at hand, wearable garments with an interlock attaching strap system were developed by the United States Army Natick Soldier Research, Development and Engineering Center. U.S. Pat. No. 5,724,707 to Kirk et al. discloses a system for removably securing smaller objects (e.g., pouches) to a load-bearing platform, such as a vest or backpack. The system, also referred to as Modular Lightweight Load-carrying Equipment or MOLLE, includes a mounting panel on the first object (e.g., garment), where the mounting panel includes strips of webbing evenly spaced and stitched across the mounting surface, also known as PALS webbing (pouch attachment ladder system). The PALS grid consists of horizontal rows of 1-inch Mil-W-43668 Type III nylon webbings that are spaced one inch apart and secured to the backing at 1.5 inch intervals. The spacing between the webbing rows allows webbings on a second object (e.g., a pouch) to fit therebetween. The webbings are secured with stitching perpendicular to the webbing to create channels between the webbing and the garment through which a strap may be inserted.

In an example of using the MOLLE system, a pouch has at least one attached flexible strap that extends vertically along the back of the pouch. One end of the flexible strap is secured near the pouch opening and the other end of the strap has a snap button that engages a snap post near the base of the pouch. Webbings on the garment receive the webbings on the pouch in an interlocking fashion. The strap of the pouch is passed through the webbings on the garment and then again through the webbings on the pouch in an interlocking fashion in order to effectively and removably mount the pouch to the garment. The fastener part at the lower end of the strap is then attached to a corresponding fastener part on the back surface of the pouch. Backpacks, vests, and other wearable garments employ the interlock attaching system to enable the user to position necessary pouches or other objects where they are most useful to the individual user.

A variation on the MOLLE system is a quick-mount interlocking attaching system disclosed in U.S. Pat. No. 7,080,430 to Wemmer. The Wemmer system includes a one-piece molded substrate adapter, a one-piece molded accessory adapter, and a discrete locking member. The substrate adapter has a flat base that is affixed to the object (e.g., vest). Raised regions are formed on the base at spaced-apart locations and aligned along an axis and include slots to define openings. The accessory adapter is similarly constructed with a flat base having raised regions in a spaced-apart relation along a second axis, where the raised regions also have slots that define openings. The raised regions on the accessory adapter are spaced to occupy voids between the raised regions on the substrate adapter. The locking member has a leading end and a trailing end and is removably insertable leading-end-first through the passages on the raised regions of both adapters to interlock the accessory adapter to the substrate adapter.

SUMMARY OF THE INVENTION

While MOLLE interlock attachment systems and PALS webbing have been implemented on vests, backpacks, tactical clothing, and mountaineering equipment, the interlock attachment systems have not adequately addressed the needs of workers who use hand tools on a jobsite. Particularly, MOLLE-compatible pouches and pockets used for tactical applications typically use a snap button fastener at the end of the strap, where the corresponding snap on the pouch is located on the rear face of the pouch. If the pouch catches on another object and is pulled away from the garment, the snap-button fastener can be inadvertently disconnected and allow the pouch to become detached from the garment. Similarly, accidental release of the locking member of the Wemmer system allows the accessory pocket to quickly become decoupled from the garment. Additionally, a fastener located between a pouch and the garment creates a region that can be uncomfortable and sometimes painful when impacted against one's body Additionally, tactical MOLLE-compatible vests and other garments have webbing or interlock members aligned in horizontal rows across the garment. While magazine pouches, flashlight holders, and other pouches are useful when oriented vertically (since fastened perpendicular to the webbing), workers on a ladder or other precarious position often need to be able to access and operate a tool with only one hand. Doing so is easier when the tool pouch is angled in a "cross-draw" orientation with respect to a vertical axis, where the pouch opening is oriented upward and inward towards the garment center line, such as when angled upward towards the centrally-located front opening of a vest. Thus, the worker may reach across the body (e.g., with the right hand) to retrieve a tool from a pocket located on the opposite-side (e.g., on the user's left, front or left side) of the garment and angled conveniently for easy access.

Due to the deficiencies of prior art tool vests and MOLLE systems, a need exists for an improved modular garment system for hand tools. Embodiments of the present invention address the deficiencies of the prior art by providing a system employing a modular garment and accessory attachments therefor.

In one aspect of the present invention, a modular tool storage garment includes a wearable upper-body garment with a garment front panel and a garment rear panel. For example, the garment is a vest. The garment has a plurality of first webbings secured to the garment front panel in a substantially parallel relation, where each of the first webbings defines at least one passageway between the webbing and the front panel and passing perpendicular to the webbing. The first webbings extend superiorly and laterally away from a sternal region dividing the garment front panel into a right half and a left half.

In another embodiment, the garment includes a plurality of second webbings secured to the garment front portion in a substantially parallel relation. Each of the plurality of second webbings defines a plurality of second passageways between the webbing and the garment, where the passageways extend generally perpendicular to the webbing. Each of the plurality of second webbings is substantially horizontal as viewed with the garment donned by a user in a standing, upright position.

In some embodiments, the garment includes at least one tool holder or accessory pouch configured to attach to the webbings of the garment.

In another embodiment, the system includes a safety harness attached to the garment and including a left shoulder strap, a right shoulder strap, a left leg loop, and a right leg loop. In another embodiment, the safety harness includes a harness loop secured to the garment rear surface and to the harness.

In another embodiment, the garment includes one or more garment tether pockets secured to an inside surface of the front panel, where each of the one or more garment tether pockets is sized and configured to house a retractor body with a retractable tether cord. For each garment tether pocket, the front panel defines at least one garment tether opening sized for passage of the retractable tether cord.

In another aspect of the present invention, a tool pouch compatible with MOLLE/PALS webbing includes a holder body defining a tool compartment with a holder opening, a holder back surface extending along a longitudinal pouch axis, and a holder bottom surface. The tool holder has at least one strap with a strap proximal end portion, a strap body portion, and a strap distal end portion, where the strap proximal end portion is secured to the holder back surface adjacent the holder opening and the strap body portion extends along the holder back surface to the strap distal end portion. A connector first portion is secured to the strap distal end portion of each strap. A connector second portion is secured to a bottom end portion of the tool holder and configured to mate with and engage the connector first portion to secure the strap distal end portion to the tool holder.

In one embodiment, a strap extends at an angle along the holder back surface with respect to the central pouch axis. For example, the strap extends diagonally across the back surface.

In another embodiment, the connector first portion of a strap has at least two corresponding connector second portions. For example, a single strap with a single connector first portion may be connected to one of a plurality of connector second portions, thereby allowing the user to choose between the strap extending longitudinally and the strap extending at an angle across the back surface of the tool holder with respect to the longitudinal pouch axis. This option allows the user to use the tool holder with a variety of MOLLE/PALS systems and achieve a tool holder angled with respect to a vertical axis.

In another embodiment, the connector second portion is secured to the holder bottom surface. In one embodiment, the connector second portion is secured through the holder bottom surface. In some embodiments, the holder bottom surface and the back surface define an acute internal angle.

In another embodiment, the holder body is made of a pliable material and the holder includes a self-tightening strap secured to and extending between a first side portion and a second side portion of the holder body and extending across a middle portion of the holder body. The self-tightening strap comprises an elastic material and is sized to bias the tool compartment towards a closed state along the middle portion. Elastic properties of the self-tightening strap urge the middle portion against an implement installed in the tool compartment to frictionally engage the implement, thereby preventing the implement from accidental removal from the tool compartment.

DETAILED DESCRIPTION OF THE PREFERRED EMBODIMENT

Figure 1:
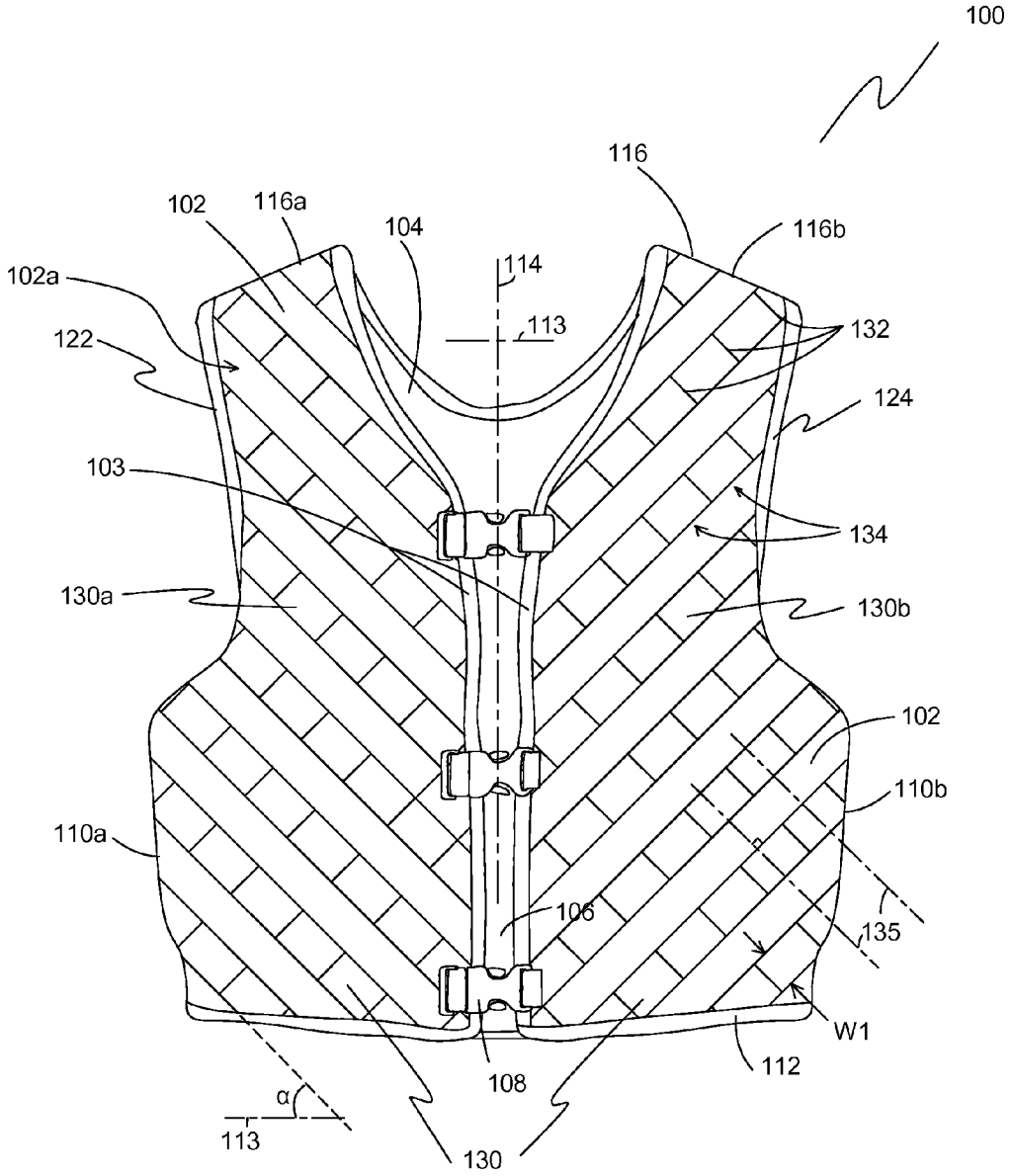
FIG. 1 is a front elevational view of one embodiment of a garment of the present invention showing inclined webbings attached to a front surface.

The preferred embodiment(s) of the present invention is illustrated in FIGS. 1-14. FIG. 1 shows a front view of one embodiment of a wearable garment 100 of the present invention. As shown, garment 100 is a vest with a front panel 102 and a back panel 104. A sternal region 103 extends vertically along the middle of front panel 102 and generally divides front panel 102 into a right half 122 and a left half 124. A central longitudinal garment axis 114 extending along sternal region 103. In one embodiment, right half 122 and left half 124 are generally symmetrical. In one embodiment, front panel 102 and back panel 104 are made of a breathable polyester mesh, but other fabrics, cloths, and materials are acceptable.

In one embodiment, garment 100 has an opening 106 to permit the user to don and take off garment 100. In other embodiments, garment 100 is configured as a pull-over shirt or vest that has adjustable straps to tighten garment 100 on the user after donning. Opening 106 may be on front panel 102 (e.g., along sternal region 103), on back panel 104, along one or both side seams 110*a*, 110*b* between front panel 102 and back panel 104, or at other locations on garment 100. In one embodiment, opening 106 is selectively openable and closable by the user with a closure 108. Closure 108 may be a zipper, straps with clips, hooks, straps, ties, buttons, or any other closure deemed appropriate and sufficiently secure for the intended use. Optionally, garment 100 includes sleeves (not shown).

A plurality of first webbings 130 are secured to an outside surface 102*a* of front panel 102 and extend upward and outward from sternal region 103 and/or central longitudinal garment axis 114 as viewed in FIG. 1. That is, first webbings 130 extend superiorly (i.e., towards the user's head) and laterally (i.e., towards the side) from sternal region 103. First webbings 130 include first right webbings 130*a* and first left webbings 130*b*, which are attached to front panel 102 between a respective right shoulder portion 116*a* or left shoulder portion 116*b*, waist 112, and sternal region 103. First webbings 130 are substantially parallel to each other and have a webbing width W1. In one embodiment, first webbings 130 are spaced apart from each other by webbing width W1 or more, thereby allowing corresponding webbings on an accessory to be received between webbings 130.

First webbings 130 are secured to front panel 102 with fasteners 132 at evenly-spaced locations. Fasteners 132 may be, for example, stitching, rivets, snaps, or other fastener 132. Consistent with known MOLLE/PALS webbing panels, spaced-apart fasteners 132 on each first webbing 130 define passageways 134 between webbing 130 and front panel 102, where each passageway 134 is aligned along a passageway axis 135 generally perpendicular to first webbings 130. For example, first webbings 130 are made of heavy-duty nylon with a webbing width W1 of about one inch (2.54 cm) and are secured to front panel 102 by stitching that extends perpendicularly across webbing width W1 and spaced about every 1.5 inches (3.81 cm) along the webbing. First webbings 130 may be made of other materials, including woven and non-woven fabrics, stretchable fabrics, and other webbings. Other values for width W1 and fastener spacing are acceptable. Consistent with MOLLE/PALS systems of the prior art, fasteners 133 and passageways 134 of adjacent webbings 130 are generally aligned along axis 135 extending perpendicular to webbings 130.

In one embodiment, some or all of first webbings 130 are inclined at an angle $\alpha$ of about 45° with respect to a horizontal axis 113. Other values of angle $\alpha$ are also acceptable, such as 20°, 30°, and 37.5°. In some embodiments, first right webbings 130*a* are inclined with respect to horizontal axis 113 and have a value of a that is different from that of first left webbings 130*b*. For example, first right webbings 130*a* are inclined at 45° and first left webbings are inclined at 30°. In other embodiments, first right webbings 130*a* or first left webbings 130*b* are parallel to horizontal axis 113.

Figure 2:
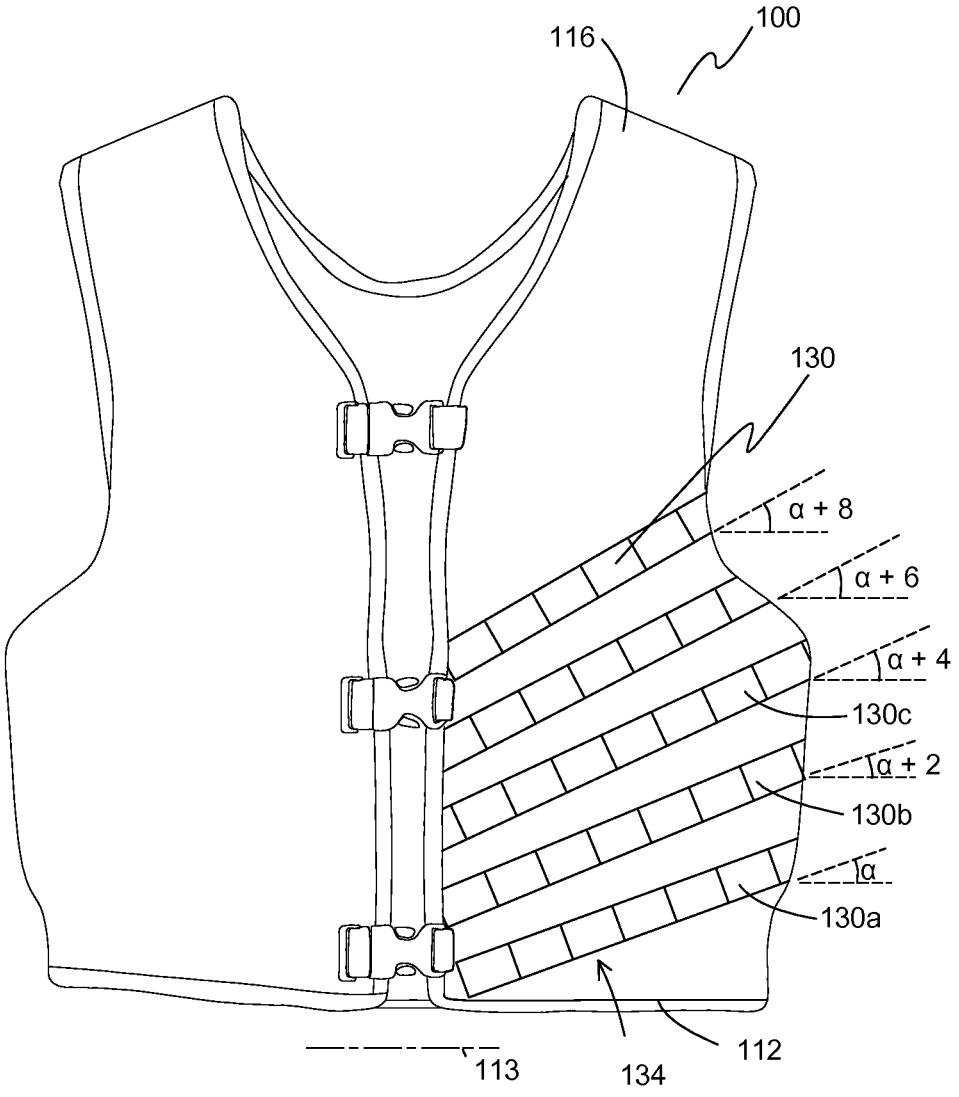
FIG. 2 is a front elevational view of another embodiment of a garment of the present invention showing a plurality of webbings, each of which inclines slightly more than the webbing below it.
Figure 3:
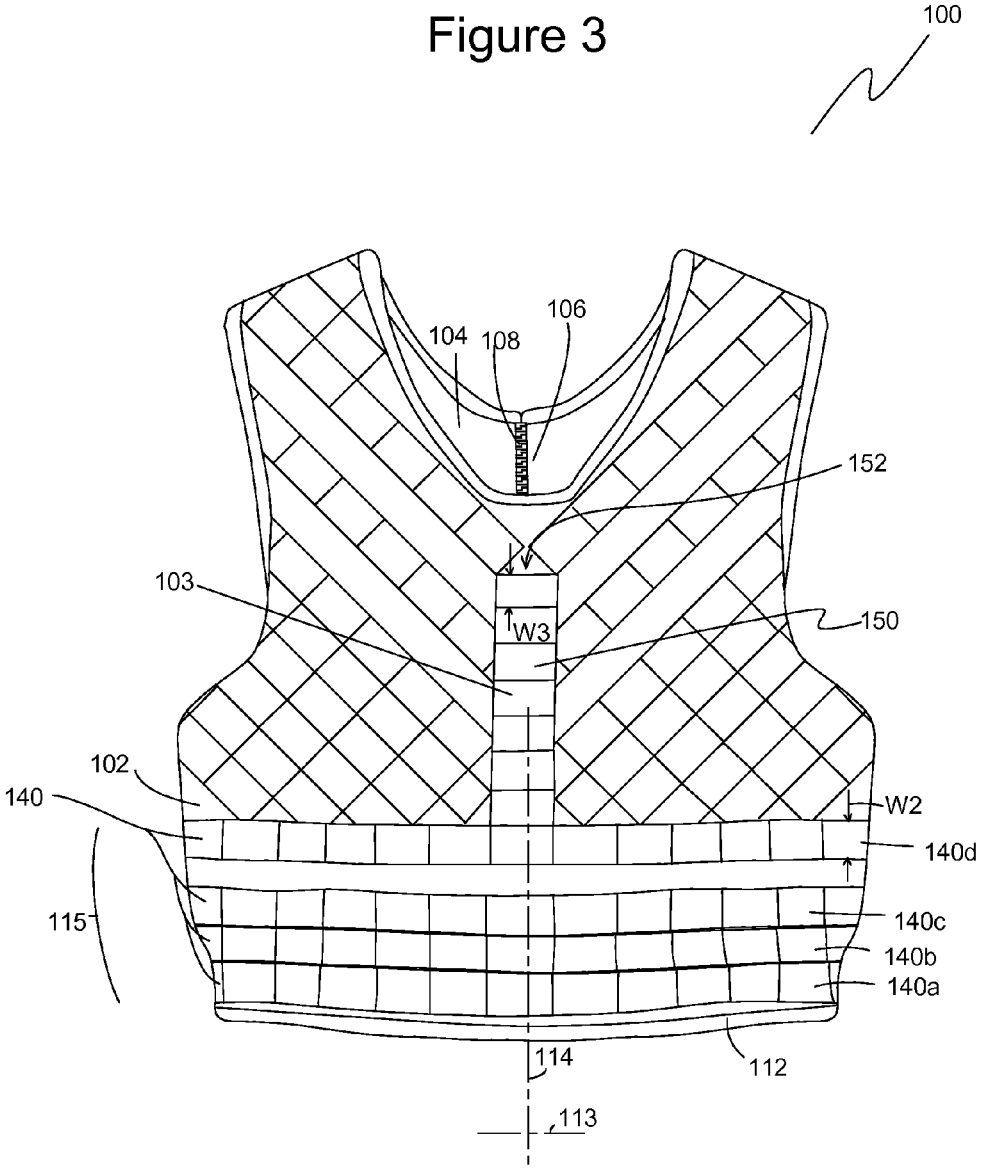
FIG. 3 is a front elevational view of another embodiment of a garment of the present invention showing a plurality of first webbings inclined to the horizontal, a plurality of second webbings parallel to the horizontal, and a plurality of sternal webbings oriented along a medial line.

Referring now to FIG. 2, another embodiment of garment 100 is shown with first webbings 130 inclined to horizontal axis 113 at different angles. For example, some or all of first webbings 130 incline in increasing angles moving vertically from waist 112 towards shoulder 116. As shown in FIG. 3, for example, each of first left webbings 130*b* inclines at angle $\alpha$ that is 2° greater than angle $\alpha$ for the adjacent webbing 130 below it. As a result, webbing row 130*a* of first left webbings 130 closer to waist 112 inclines at angle $\alpha$ (e.g., 30°.) Next webbing row 130*b* inclines at $\alpha$+2 (e.g., 32°), next webbing row 130*c* inclines at $\alpha$+4 (e.g., 34°), and so on. Angle $\alpha$ increases a fixed amount of about 1-3° for each webbing 130 moving up garment 100 from waist 112 towards shoulder 116. Since passageways 134 will be somewhat out of alignment, the position of adjacent webbings 130 may be adjusted as needed so that attachment straps of an accessory pouch or the like can extend through two to three passageways 134.

Referring now to FIG. 3, a front elevational view shows another embodiment of garment 100. In this embodiment, opening 106 and closure 108 are located along back panel 104. Locating opening 106 on back panel 104 increases the area on front panel 102 available for attachment of accessory pouches and the like. Garment 100 includes a second plurality of webbings 140 attached to and extending horizontally across a lower region 115 of front panel 102. For example, second webbings 140 include two to five rows of webbing 140 on lower region 115 with the bottom-most webbing 140*a* positioned along or just above waist 112. Second webbings 140 may be closely adjacent one another or spaced apart by webbing width W2 similar to first webbings 130 as noted above. Typically, webbing width W2 is equal to webbing width W1, but this is not required. As an example using one-inch-wide (2.54 cm) webbing, the bottom three rows of second webbings 140 are abutting or nearly abutting one another where three rows of webbings 140*a*, 140*b*, 140*c* occupy about three inches (7.62 cm) on front panel 102. Fourth row of webbing 140*d* is spaced above third row webbing 140*c* webbing by about one inch (2.54 cm) (webbing width W2). In other embodiments, additional horizontal webbings 140 may be used on garment 100 in other desired areas, such as near shoulders 116.

Optionally, garment 100 includes a plurality of horizontal sternal webbings 150 on sternal region 103. Sternal webbings 150 extend parallel to horizontal axis 113 and have a significantly reduced length compared to waist 112. For example, each sternal webbing 150 defines one to three sternal passageways 152 similar to passageways 134 as discussed above for first webbings 130. Sternal webbings 150 are disposed in a parallel relation, typically with a sternal passageway 152 of each sternal webbing 150 centered along sternal region 103 and along longitudinal garment axis 114. In one embodiment, sternal webbings 150 are spaced from each other by sternal webbing width W3. In other embodiments, some or all of sternal webbings 150 are positioned to abut or nearly abut each other. In one embodiment, sternal webbings width W3 is the same as webbing width W1 for first webbings 130. In other embodiments, sternal webbing width W3 is less than or greater than webbing width W1, such as for specialty pouches for small items.

Figure 4:
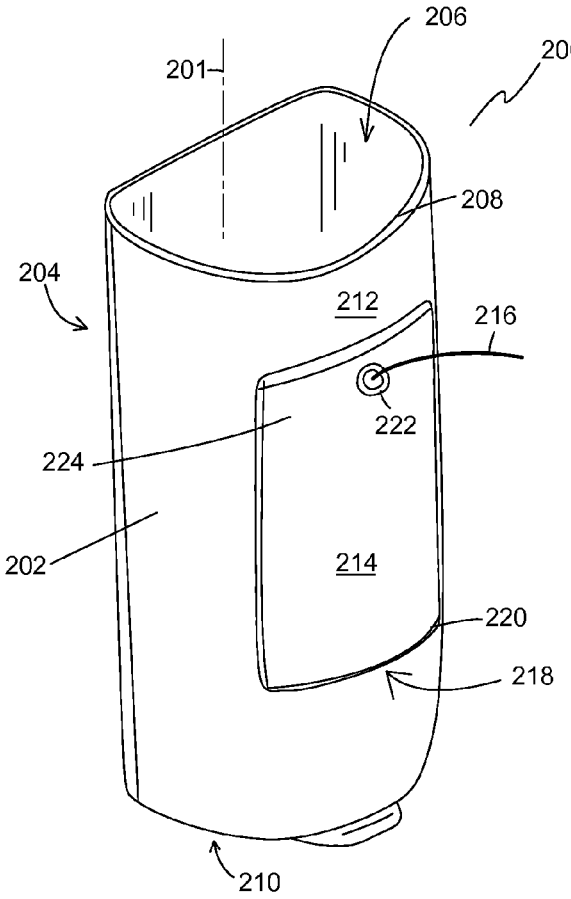
FIG. 4 is a front perspective view of one embodiment of a tool holder of the present invention with a retractor pouch.

Referring now to FIG. 4, a front perspective view illustrates one embodiment of a tool holder 200 configured to attach to first webbings 130, second webbings, and/or sternal webbings 150 discussed above. Pouch 200 has a holder body 202 defining a back surface 204 extending along a longitudinal pouch axis 201, a tool compartment 206 with an opening or mouth 208, and a bottom surface 210. Tool compartment 206 extends longitudinally from opening 208 to bottom surface 210. In some embodiments, tool holder 200 is made of a pliable fabric. Tool holder 200 may also be made of stiff or rigid materials, such as plastic or reinforced fabric, so that tool holder 200 maintains its shape with an open tool compartment 206.

In some embodiments, a retractor pocket 214 is defined on or attached to a front surface 212 for holding a retractable tether 216. Similarly, in other embodiments, retractor pocket 214 is attached to or built into back surface 204 of tool holder 200. In some embodiments, retractor pocket 214 has an opening 218 along a lower edge 220 for installing or removing retractable tether 216 from retractor pocket 214. Opening 218 alternately may be positioned along a side or top edge of retractor pocket 214. In some embodiments, opening 218 can be opened and closed selectively by including hook-and-loop fastener strips (not shown) along opening 218. Other connectors, such as a zipper, snaps, and the like are also acceptable for opening and closing opening 218. Optionally, retractor pocket 214 has a separate tether opening 222 in an upper portion 224 of retractor pocket 214, or in other convenient areas of retractor pocket 214. For example, tether opening 222 is constructed with a grommet, an unstitched area, a button hole, or other opening. In some embodiments, tether opening 222 is an unsecured portion of opening 218.

Figure 5:
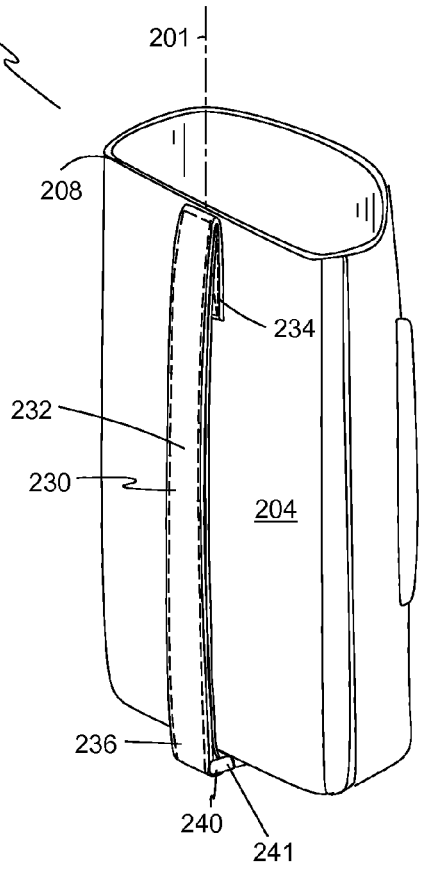
FIG. 5 is a rear perspective view of the tool holder of FIG. 4 showing a strap fixedly attached to a back surface.

Referring now to FIG. 5, a rear perspective view shows tool holder 200 of FIG. 4 with a strap 230 fixedly attached to back surface 204. Strap 230 includes a strap body portion 232 extending longitudinally between a strap proximal end portion 234 and a strap distal end 236. Strap proximal end portion 234 portion is fixedly attached, such as by stitching, to back surface 204 adjacent pouch opening 208. A connector first portion 241 of a connector 240 is secured to strap distal end portion 236. For example, strap 230 loops through an opening in connector first portion 241, which may be the male part of a clip buckle. In one embodiment, strap 230 is generally aligned along longitudinal pouch axis 201 and is centered laterally on back surface 204. In some embodiments, strap body portion 232 is reinforced with a plastic strip to increase its stiffness for easier insertion through passageways 134.

Figure 6:
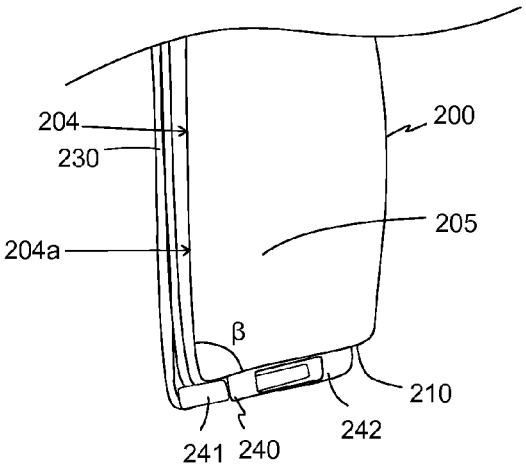
FIG. 6 is a side elevational view of part of the tool holder of FIG. 4 showing the bottom surface inclined to the back surface and a connector attached to the bottom surface.

Referring now to FIG. 6, a side elevational view shows a lower end portion 205 of tool holder 200 of FIGS. 4-5. Lower end portion 205 includes a lower back surface 204*a* and holder bottom surface 210. Strap 230 extends along back surface 204 and connects to connector first portion 240. Connector second portion 242 is fixedly attached to holder bottom surface 210. In some embodiments where connector 240 is a clip buckle, connector second portion 242 is the female portion of the clip buckle and is secured through bottom surface 210 of tool holder 200. In one embodiment, bottom surface 210 defines an internal acute angle $\beta$ with pouch back surface 204, where $\beta$ is about 75°. When angle $\beta$ is less than 90°, connector 240 is less prone to accidental disengagement and is also more easily accessed by the user when disengagement is desired to remove or attach tool holder 200 to garment 100.

Figure 7:
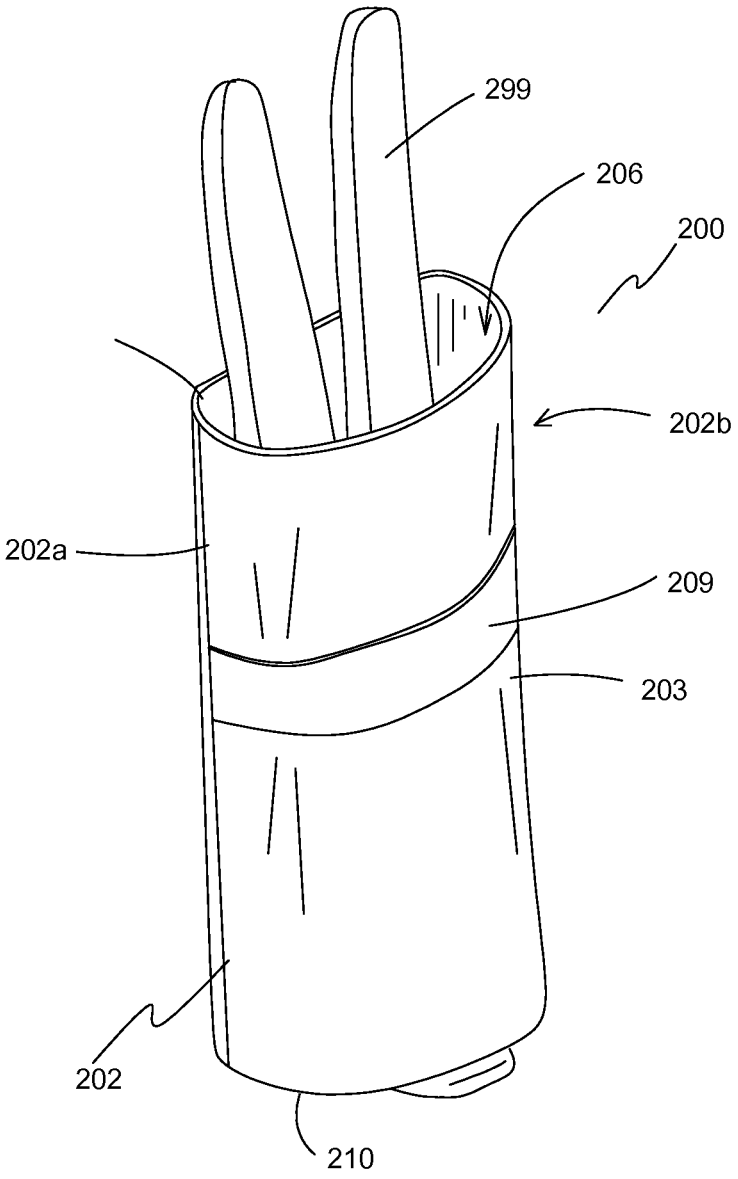
FIG. 7 is a front perspective view of another embodiment of a tool holder of the present invention showing a self-tightening strap disposed across the front of the holder.

Referring now to FIG. 7, a front perspective view illustrates another embodiment of tool holder 200 of the present invention. Holder body 202 includes a self-tightening strap 209 attached to sides 202*a*, 202*b* of holder body extending transversely across a middle portion 203 located between opening 208 and bottom surface 210. In one embodiment, self-tightening strap 209 is located about halfway between opening 208 and bottom surface 210. Self-tightening strap 209 is made of or contains an elastic material and is secured in a tensioned state across tool holder 200 when tool compartment 206 is fully open. Accordingly, self-tightening strap 209 is biased to have a shorter length and applies pressure against holder body 202 to bias tool compartment 206 towards a closed state along middle portion 203. In this embodiment, holder body 202 is made of a pliable material that allows tool compartment 206 to deform or crush due to the elastic properties of self-tightening strap 209. When the user installs a tool or implement 299 into tool holder 200, the elastic properties of self-tightening strap 209 allow it to expand to a longer length and permit implement 299 to be inserted into tool compartment 206 past self-tightening strap 209. The elastic properties of self-tightening strap 209 then urge middle portion 203 against implement 299 installed in tool holder 200 and help retain it in tool compartment 206 due to frictional engagement between middle portion 203 and implement 299.

Figure 8:
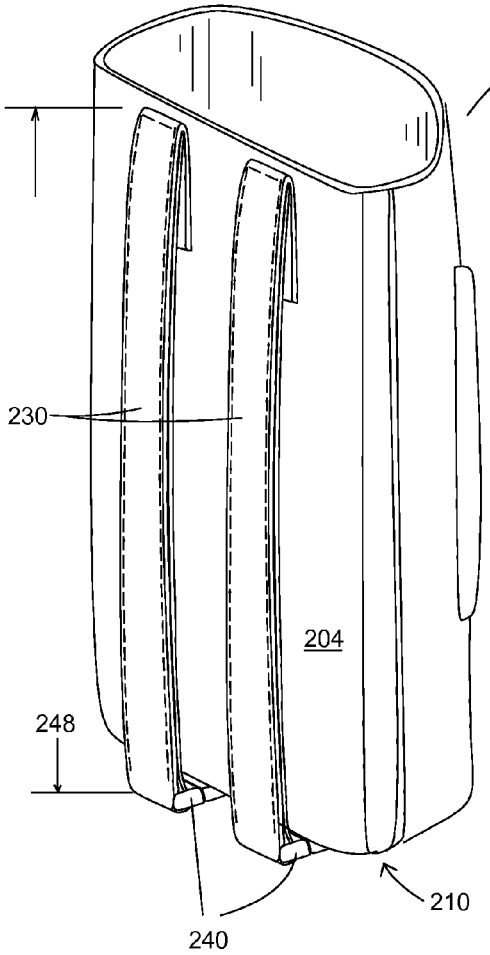
FIG. 8 is a rear perspective view of another embodiment of a tool holder of the present invention showing two straps, each of which has a connector attached on the bottom surface.
Figure 9:
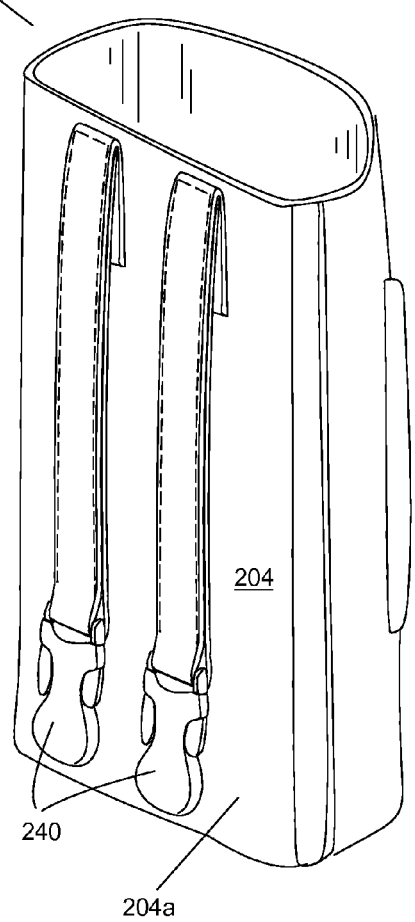
FIG. 9 is a rear perspective view of another embodiment of a tool holder of the present invention showing two straps, each of which has a connector attached to the back surface.

Referring now to FIG. 8, a rear perspective view shows another embodiment of tool holder 200 with a plurality of straps 230. Straps 230 are secured to back surface 204 with strap body 232 of straps 230 spaced apart and generally parallel to one another. In other embodiments as shown in FIG. 9, connectors 240 attach to a lower back surface 204*a* of tool holder 200. Straps 230 are configured and positioned to extend through passageways 134 of any or all of webbings 130, 140, 150 on garment 100. When connector second portion 242 is fixed to bottom surface 210, a strap length 248 and tool holder 200 may be sized as compact as desired while still allowing attachment to webbings 130, 140, 150. For example, for tool holder 200 intended to attach to webbings 130 spaced apart by webbing width W1, tool holder may be sized to extend only minimally past the uppermost and lowermost webbings 130 used for attachment. Further, when connector 240 is against bottom surface 210 as shown in FIG. 8 rather than against back surface 204 as shown in FIG. 9, connectors 240 do not press into the user's body to cause discomfort, especially when garment 100 is made of a relatively thin material that allows the user to feel protrusions and objects through the material.

Figure 10:
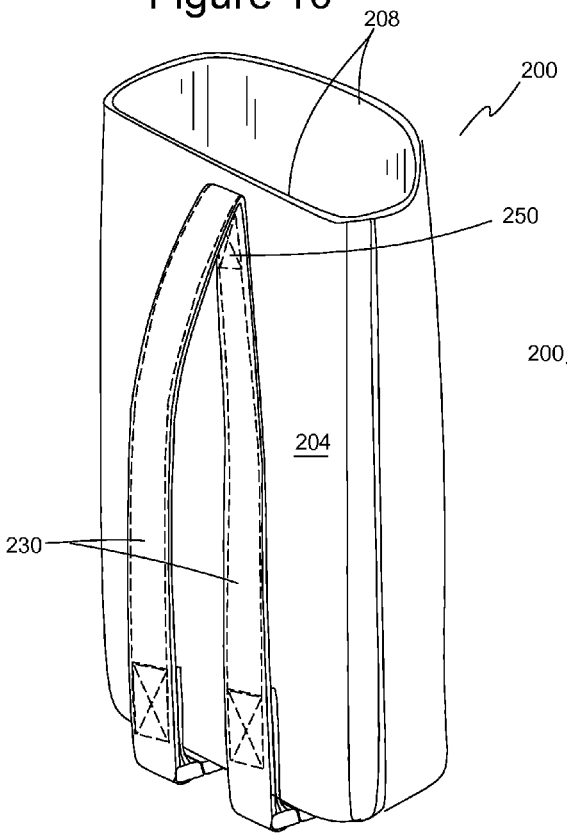
FIG. 10 is a rear perspective view of another embodiment of a tool holder of the present invention showing straps extending from a single or overlapping point of attachment adjacent the holder opening.

Referring now to FIG. 10, a rear perspective view shows straps 230 of another embodiment of tool holder 200. In this embodiment, straps 230 are fixedly attached to back surface 204 at a common or overlapping point of attachment 250, such as one centered laterally on back surface 204 adjacent pouch opening 208. In one embodiment, straps 230 are made of a single length of material that is folded into an inverted V shape, where the point of the V is point of attachment 250. In other embodiments, straps 230 are individual lengths of material that have proximal end portions 234 secured, such as by stitching, to back surface 204 at a common or overlapping point of attachment 250.

Figure 11:
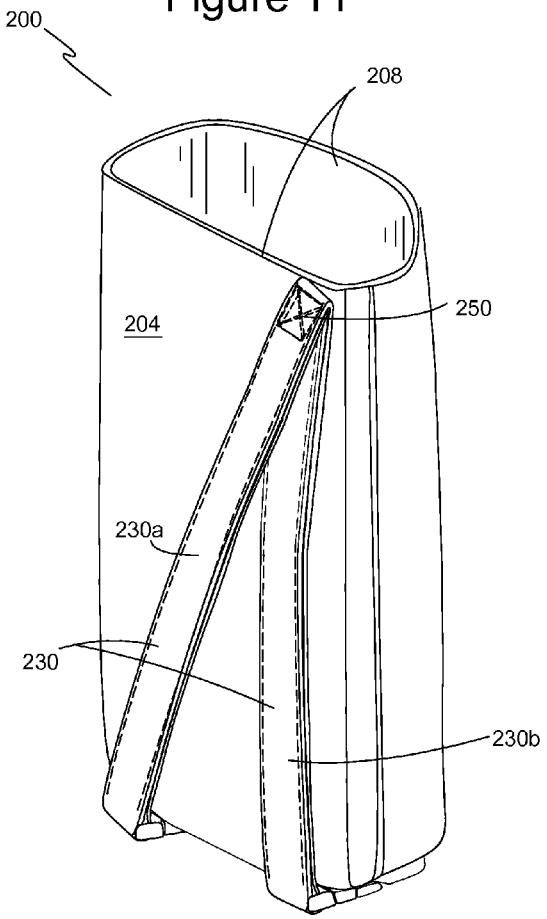
FIG. 11 is a rear perspective view of another embodiment of a tool holder of the present invention showing straps extending from a single or overlapping point of attachment near an upper corner of the back surface, where one strap extends diagonally across the back surface and another strap extends longitudinally along the back surface.

Referring now to FIG. 11, a rear perspective view shows another embodiment of tool holder 200, where straps 230 are made of a single length of material into an inverted V shape. Here, point of attachment 250 is located to one side of back surface 204 along holder opening 208. First strap portion 230*a* extends towards an opposite corner of back surface 204 and second strap portion 230*b* extends parallel to central pouch axis 201 along one side 204*a* of back surface 204. Such an embodiment allows tool holder 200 to occupy various orientations on PALS webbing, whether extending parallel to or inclined with respect to a horizontal axis 113. If first strap portion 230*a* is used on horizontal webbings, tool holder 200 will have an inclined position. On the other hand, if second strap portion 230*b* is used on horizontal webbings, tool holder 200 will have a vertical position. Both of first and second strap portions 230*a*, 230*b* may be used for an intermediate or slightly inclined position of tool holder 200.

Figure 12:
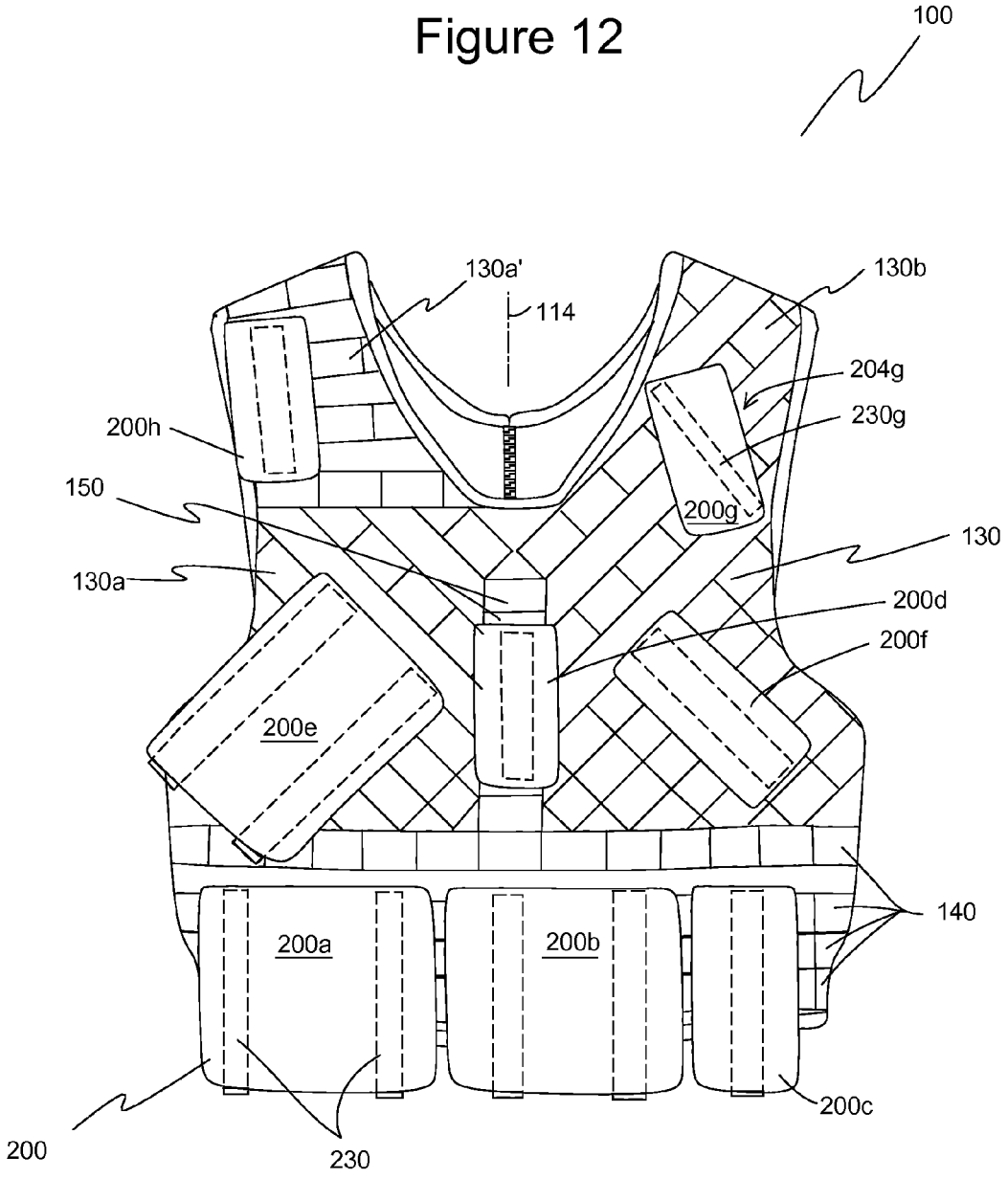
FIG. 12 is a front elevational view of another embodiment of a garment of the present invention shown with a plurality of tool holders attached to webbings in various locations on the front panel.

Referring now to FIG. 12, a front elevational view shows one embodiment of garment 100 with a plurality of tool holders 200 installed on first webbings 130, second webbings 140, and sternal webbings 150. Straps 230 of each tool holder 200 are illustrated in broken lines. First webbings 130 include first right webbings 130*a* & 130*a*' and first left webbings 130*b*. Tool holders 200*a*, 200*b*, 200*c* are installed on second webbings 140. Tool holder 200*d* is installed on sternal webbings 150. Tool holder 200*e* is installed on first right webbings 130*a*. Tool holders 200*f*, 200*g* are installed on first left webbings 130*b*. Tool holder 200*g* has strap 230*g* extending diagonally across back surface 204*g*, which enables tool holder 200*g* to be installed in a slightly inclined position. Tool holder 200*h* is installed on additional first right webbings 130*a*', which include a webbing that extends substantially horizontally, and webbings above it that incline upwards toward medial line at 3°, 6°, and 9° moving from low to high as shown in FIG. 12.

Figure 13:
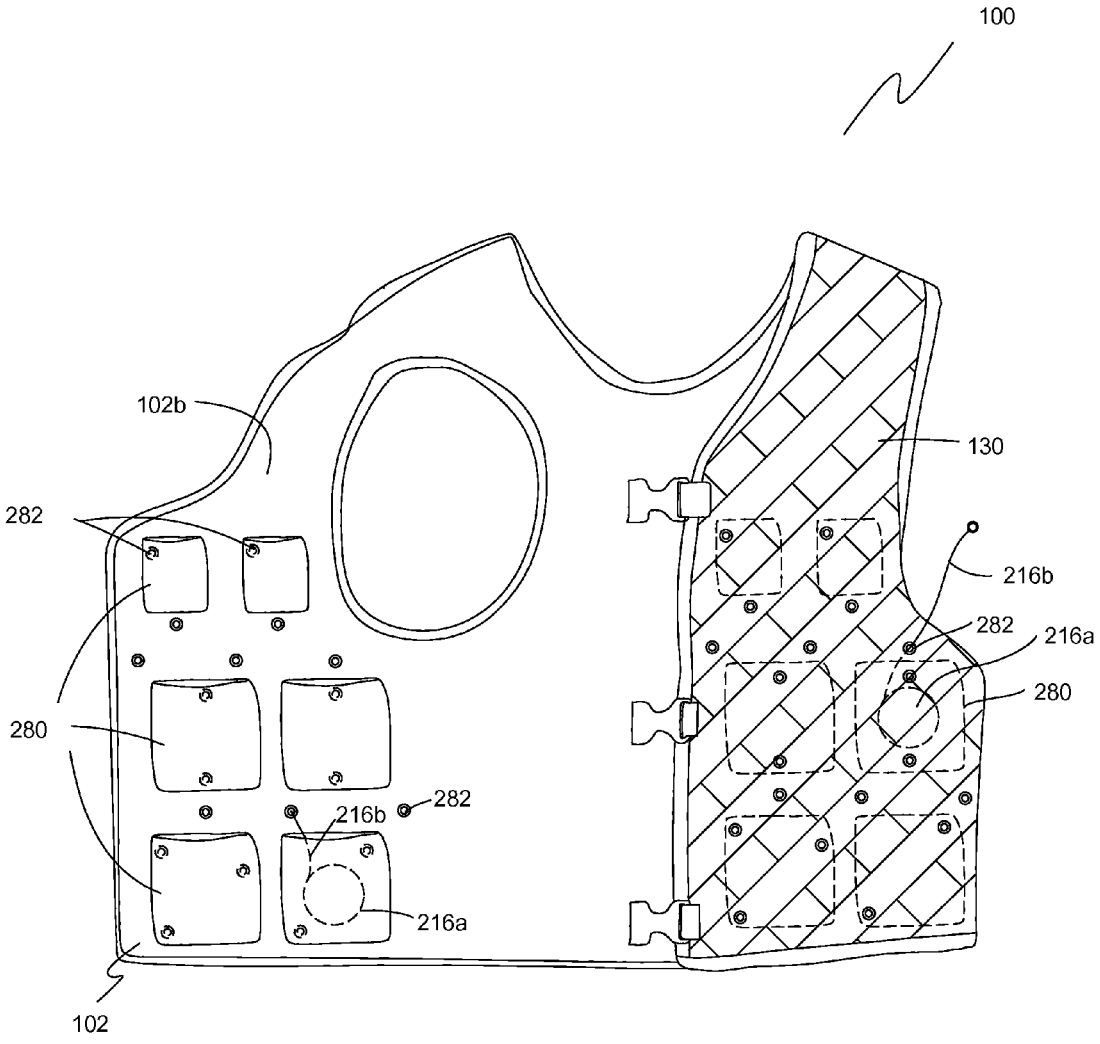
FIG. 13 is a front elevational view of another embodiment of a tool garment of the present invention showing retractor pockets and passageways for a retractable tether.

Referring now to FIG. 13, a front elevational view shows another embodiment of garment 100 in a partially open configuration. Garment 100 includes one or more garment retractor pockets 280 fixedly attached to an inside surface 102*b* of front panel 102. In one embodiment, each garment retractor pocket 280 is made by securing a piece of fabric to inside surface 102*b* of front panel 102 to define a compartment within the garment retractor pocket 280. As discussed with retractor pocket 214 on tool holder 200, each garment retractor pocket 280 is sized and configured to hold a retractor body 216*a* with a retractable tether cord 216*b*. In some embodiments, each garment retractor pocket 280 has an access opening 284 for installing or removing retractor body 216*a*. Access opening 284 may be positioned along an edge or across face of garment retractor pocket 280. In some embodiments, access opening 284 can be opened and closed selectively by including hook-and-loop fastener strips (not shown) along access opening 284. Each garment retractor pocket 280 has one or more garment tether openings 282 through front panel 102 through which retractable tether cord 216*b* extends to connect to a tool or implement 299 disposed in tool holder 200 or other accessory on garment 100. Garment tether openings 282 are sized to allow passage of retractable tether cord 216*b*, but not retractor body 216*a*. Garment tether openings 282 may be a grommet, slit, or other passage through front panel 102 that is sized for passage of retractable tether cord 216*b*. Preferably, garment tether openings 282 are positioned on front panel 102 between first webbings 130. In some embodiments, retractable tether cord 216*b* extends through access opening 284 or other opening in garment retractor pocket 280 before passing through garment tether opening 282 in front panel 102.

Figure 14:
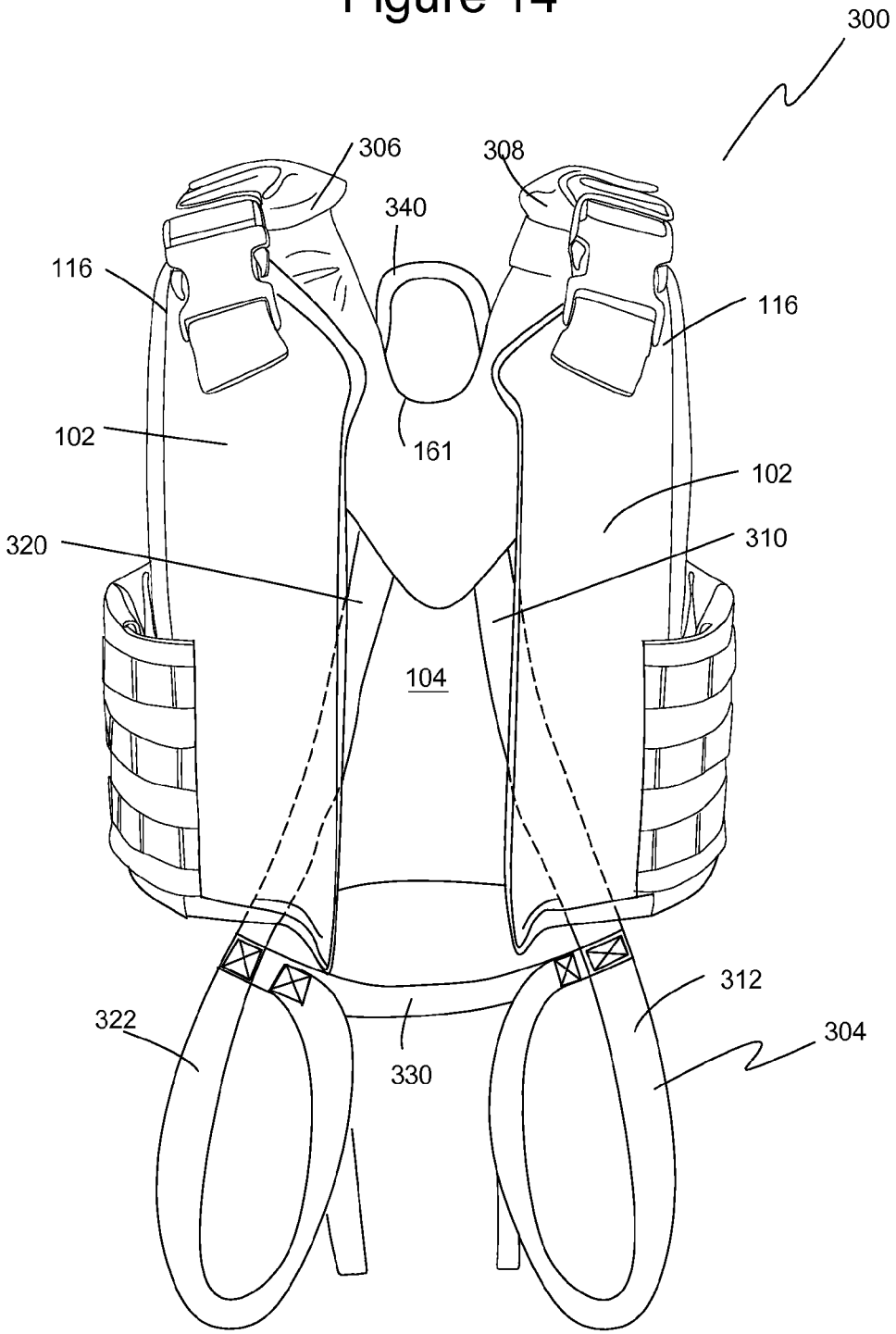
FIG. 14 is a front elevational view of one embodiment of a combination tool garment and safety harness, where the garment may employ webbings of the other garment embodiments.

Referring now to FIG. 14, a front elevational view illustrates one embodiment of a tool garment/safety harness combination 300. Combination 300 includes a pair of adjustable shoulder straps 306, 308 that extend between and connect rear panel 104 and front panel 102 of garment 100 at shoulders 116. Left strap 310 extends from rear panel 104 to an adjustable left leg loop 312. Similarly, a right strap 320 extends from real panel 104 to an adjustable right leg loop 322. A torso strap 330 extends between and connects right strap 320 and left strap 310. A rear ring 340 (e.g., a D-ring) is secured to harness 304 and rear panel 104 garment 100 constructed for attachment of a fall-prevention tether (not shown). Preferably, rear panel 104 has a recess or cutout 161 for rear ring 340. Cutout 161 allows rear ring 340 to be positioned below the user's shoulders and neck. In one embodiment, rear ring 340 is a D-ring rated for 400 pounds (181 kg). Garment 100 and harness 304 are integrally connected, which simplifies donning harness 304 compared to stand-alone harnesses of the prior art. Also, garment 100 helps distribute fall forces exerted on harness 304 in the event of a fall. As with embodiments of garment 100 discussed above, combination 300 includes one or more of first webbings 130, second webbings 140, and/or sternal webbings 150 for attachment of tool holders 200, pouches, and accessories compatible with MOLLE/PALS webbing.

In use, first webbings 130, second webbings 140, and sternal webbings 150 may be used to configure garment 100 for attachment of accessories and pouches in optimal locations and orientations for workers who use hand tools. When garment 100 includes one or more regions with horizontal webbings, inclined webbings, inclined webbings at various angles α, and sternal webbings, and when tool holders 200 include straps 230 configured for use with such webbings, a worker has many, many options available for a tool vest or other garment 100 with a customizable arrangement of removable accessories, such as tool holders 200. Of course, garment 100 can be used with other known accessory pouches, and attachments compatible with MOLLE/PALS webbing. When attaching a pouch or accessory to garment 100 using first webbings 130, the pouch or accessory is inclined with its opening in a "cross-draw" orientation and facing upwards an inwards at an angle defined by the webbings. The user then has improved access to the inclined pouch, which improves efficiency and reduces the frequency of dropped tools. When integrally combined with a harness 304, garment 100 becomes a safe and effective way to hold tools in addition to addressing fall prevention.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

We claim:

1. A modular tool storage garment comprising:

a wearable upper-body garment with a garment front panel and a garment rear panel; and a plurality of first webbings secured to the garment front panel in a substantially parallel relation, each of the plurality of first webbings defining at least one passageway between the webbing and the front panel, wherein each of the at least one passageway is generally perpendicular to the webbing;

a garment tether pocket secured to an inside surface of the front panel, the garment tether pocket sized and configured to house a retractor body, wherein the garment front panel defines a garment tether opening in communication with a compartment defined by the garment tether pocket;

a retractor disposed in the garment tether pocket and having a retractor tether cord extending from the retractor and through the front panel via the garment tether opening; and at least one tool holder comprising: a holder body defining a tool compartment with a holder opening, a holder back surface extending along a holder longitudinal axis, and a holder bottom surface; a first strap having a first strap proximal end portion, a first strap body portion, and a first strap distal end portion, wherein the first strap proximal end portion is secured to the holder back surface adjacent the holder opening and the first strap body portion extends longitudinally along the holder back surface to the first strap distal end portion; a second strap having a second strap proximal end portion, a second strap body portion, and a second strap distal end portion, wherein the second strap proximal end portion is secured to the holder back surface adjacent the holder opening and the second strap body portion extends longitudinally along the holder back surface to the second strap distal end portion; a connector first portion secured to each of the first strap distal end portion and the second strap distal end portion; and a connector second portion for each connector first portion, wherein each connector second portion is secured to a bottom end portion of the tool holder and configured to mate with and engage the connector first portion to secure the respective first strap distal end portion or second strap distal end portion to the tool holder; wherein the first strap proximal end portion and the second strap proximal end portion have a common point of attachment on the holder back surface that is positioned adjacent the holder opening, and wherein the first strap distal end portion is spaced apart from the second strap distal end portion.

2. The tool pouch of claim 1, wherein the connector second portion includes for each strap:

a first connector second portion secured to a bottom end portion of the tool holder and configured to mate with and engage the connector first portion to secure the strap distal end portion to the tool holder; and a second connector second portion secured to a bottom end portion of the tool holder and configured to mate with and engage the connector first portion to secure the strap distal end portion to the tool holder;

wherein the connector first portion is configured to be secured to the first connector second portion or the second connector second portion.

3. The modular tool storage garment of claim 1, wherein each of the plurality of first webbings extends superiorly and laterally away from a sternal portion at an angle to horizontal that is greater than a corresponding angle for an adjacent lower one of the plurality of first webbings.

4. The modular tool storage garment of claim 1, wherein the garment tether opening is positioned between adjacent ones of the plurality of first webbings.

5. The modular tool storage garment of claim 1, wherein the first strap proximal end portion is continuous with the second strap proximal end portion.

6. A tool pouch compatible with MOLLE/PALS webbing, the tool pouch comprising:

a holder body defining a tool compartment with a holder opening, a holder back surface with a rectangular shape extending along a longitudinal pouch axis, and a holder bottom surface;

a strap having a strap proximal end portion, a strap body portion, and one or more strap distal end portion, wherein the strap is secured to the holder back surface adjacent the holder opening and the strap body portion extends along the holder back surface to the one or more strap distal end portion;

a connector first portion secured to the one or more strap distal end portion of the strap; and a connector second portion secured to a bottom end portion of the tool holder and configured to mate with and engage the connector first portion to secure the strap distal end portion to the tool holder;

wherein the strap is configured to be inserted through passageways defined by the MOLLE/PALS webbing and the connector first portion secured to the connector second portion thereby attaching the tool holder to the MOLLE/PALS webbing; and wherein the strap body portion including a first strap body portion and a second strap body portion each extending to a first strap distal end portion and second strap distal end portion, respectively, from a common point of attachment on the holder back surface adjacent the holder opening.

7. A modular tool storage garment comprising:

a wearable upper-body garment with a garment front panel and a garment rear panel; and a plurality of first webbings secured to the garment front panel in a substantially parallel relation, each of the plurality of first webbings defining at least one passageway between the webbing and the front panel, wherein each of the at least one passageway is generally perpendicular to the webbing, and wherein each of the plurality of first webbings extends superiorly and laterally away from a sternal portion dividing the garment front panel into a right half and a left half; and a tool pouch compatible with MOLLE/PALS webbing comprising:

a holder body defining a tool compartment with a holder opening, a holder back surface extending along a holder longitudinal axis, and a holder bottom surface;

a first strap having a first strap proximal end portion, a first strap body portion, and a first strap distal end portion, wherein the first strap proximal end portion is secured to the holder back surface adjacent the holder opening and the first strap body portion extends longitudinally along the holder back surface to the first strap distal end portion;

a second strap having a second strap proximal end portion, a second strap body portion, and a second strap distal end portion, wherein the second strap proximal end portion is secured to the holder back surface adjacent the holder opening and the second strap body portion extends longitudinally along the holder back surface to the second strap distal end portion that is spaced apart from the first strap distal end portion;

a connector first portion secured to each of the first strap distal end portion and the second strap distal end portion; and a connector second portion for each connector first portion secured to a bottom end portion of the tool holder and configured to mate with and engage the connector first portion to secure the respective first strap distal end portion or second strap distal end portion to the tool holder;

wherein the first strap proximal end portion and the second strap proximal end portion have a common point of attachment on the holder back surface adjacent the holder opening, and wherein the first strap distal end portion is spaced apart from the second strap distal end portion.

8. The modular tool storage garment of claim 7, wherein the first strap proximal end portion is continuous with the second strap proximal end portion.

* * * * *